US009505218B2

(12) United States Patent
Ujiie et al.

(10) Patent No.: US 9,505,218 B2
(45) Date of Patent: Nov. 29, 2016

(54) INKJET IMAGE FORMING APPARATUS AND CLEANING METHOD FOR INKJET IMAGE FORMING APPARATUS

(71) Applicant: RISO KAGAKU CORPORATION, Tokyo (JP)

(72) Inventors: Hideyuki Ujiie, Ibaraki (JP); Tomoyuki Akiyama, Ibaraki (JP); Hiroshi Sugitani, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/813,838

(22) Filed: Jul. 30, 2015

(65) Prior Publication Data

US 2016/0031219 A1 Feb. 4, 2016

(30) Foreign Application Priority Data

Jul. 31, 2014 (JP) ..... 2014-156006

(51) Int. Cl.
*B41J 2/165* (2006.01)

(52) U.S. Cl.
CPC ..... *B41J 2/16535* (2013.01); *B41J 2/16538* (2013.01); *B41J 2/16544* (2013.01)

(58) Field of Classification Search
CPC ..... B41J 2/16535; B41J 2/16538
USPC ..... 347/33
See application file for complete search history.

(56) References Cited

U.S. PATENT DOCUMENTS 5,614,930 A 3/1997 Osborne et al.
2002/0171707 A1* 11/2002 Ara ..... B41J 2/16538 347/33
2005/0156996 A1 7/2005 Sakurai
2008/0024537 A1* 1/2008 Park ..... B41J 2/16526 347/14
2011/0057990 A1* 3/2011 Heo ..... B41J 2/16547 347/33
2014/0292869 A1* 10/2014 Mizutani ..... B41J 2/16526 347/14

FOREIGN PATENT DOCUMENTS

EP 1013435 6/2000
JP 2000-233518 8/2000

OTHER PUBLICATIONS

Search report issued Dec. 9, 2015 in corresponding European patent application, 7 pages total.

* cited by examiner

*Primary Examiner* — Jason Uhlenhake
(74) *Attorney, Agent, or Firm* — Hamre, Schumann, Mueller & Larson, P.C.

(57) ABSTRACT

An inkjet image forming apparatus includes inkjet heads each of which has two or more nozzle rows from which ink of different colors is injected (each of the nozzle rows includes nozzle holes), a wipe unit that includes wipers and carries out a wipe process to wipe away ink remained on a surface on which the nozzle rows are formed by the wipers, and a flush unit that carries out a flush process after the wipe process by injecting ink from nozzle holes into which ink of different color from color of ink that is injected from the nozzle holes flows during the wipe process. According to the apparatus, an amount of ink consumed in the flush process can be reduced and a replacement cycle of a mist-absorbing material for absorbing ink mists generated during the flush process can be prolonged.

6 Claims, 10 Drawing Sheets

INKJET IMAGE FORMING APPARATUS AND CLEANING METHOD FOR INKJET IMAGE FORMING APPARATUS

BACKGROUND OF THE INVENTION

Technical Field

The present invention relates to an inkjet image forming apparatus and to a cleaning method therefor.

Background Arts

A cleaning operation is done as one of cleaning operations in an inkjet image forming apparatus in order to keep proper ink injections from inkjet heads. In such a cleaning operation, (1) a purge process in which inks are forcibly injected from ink injection surfaces of inkjet heads, (2) a wipe process in which dusts attached onto the ink injection surface is wiped out by a wiper blade or the like together with inks remained on the ink injection surface is done, and (3) a flush process in which mixed inks staying in nozzles are forcibly injected out, are done sequentially.

A Patent Document 1 (Japanese Patent Application Publication No. 2000-233518) discloses an "ink jet recoding apparatus" that includes inkjet heads for forming dots on a record medium by injecting ink droplets from nozzles according to print data. In a flush process of the ink-jet recoding apparatus, flush conditions are changed with respect to each of the nozzles in order to do flushing (cleaning) efficiently. The flush conditions are changed by changing an amount of ink injected from each of the nozzles.

For example, in the flush process of the ink-jet recording apparatus, a nozzle that injects ink having larger thickening rate (increase rate of viscosity) is controlled so as to injects a larger amount of ink in order to recover an injection capability sufficiently.

SUMMARY OF THE INVENTION

However, in the above-mentioned ink-jet recording apparatus, consumption of ink increases due to an increase of an amount of ink used in the flush process, and a replacement cycle of a mist-absorbing material for absorbing ink mists generated during the flush process becomes short.

An object of the present invention is to provide an inkjet image forming apparatus and a cleaning method for the apparatus that can prevent increase of an amount of ink used in a flush process and can prolong a replacement cycle of a mist-absorbing material.

A first aspect of the present invention provides an inkjet image forming apparatus comprising: a plurality of inkjet heads each of which has two or more nozzle rows from which ink of different colors is injected, each of the nozzle rows including nozzle holes; a wipe unit that includes wipers and carries out a wipe process to wipe away ink remained on a surface on which the nozzle rows are formed by the wipers; and a flush unit that carries out a flush process after the wipe process by injecting ink from nozzle holes into which ink of different color from color of ink that is injected from the nozzle holes flows during the wipe process.

It is preferable that the flush unit carries out the flush process only for nozzle holes in a predetermined area located on an upstream side in a wipe direction of the wipers.

It is preferable that the wipers are inclined with respect to a transfer direction of a print sheet, and the flush unit carried out the flush process by flushing only for one of the nozzle rows of each of the inkjet heads, ink being flown into the one of the nozzle rows by the wiper during the wipe process.

Here, it is further preferable that the inkjet heads are aligned along the transfer direction so as to form two rows that are parallel to each other and are perpendicular to the transfer direction, and an inclination of the wiper for one of the two rows and an inclination of the wiper for another of the two rows are different from each other.

It is preferable that the flush unit carried out the flush process so that an amount of ink injected for flushing in the flush process is gradually made smaller sequentially from a most-upstream nozzle hole in a wipe direction of the wipers.

A second aspect of the present invention provides a cleaning method for an inkjet image forming apparatus that includes a plurality of inkjet heads each of which has two or more nozzle rows from which ink of different colors is injected, each of the nozzle rows including nozzle holes, the method comprising: carrying out a wipe process to wipe away ink remained on a surface on which the nozzle rows are formed by wipers; and carrying out a flush process after the wipe process by injecting ink from nozzle holes into which ink of different color from color of ink that is injected from the nozzle holes flows during the wipe process.

DESCRIPTION OF THE EMBODIMENT

Hereinafter, embodiments of an inkjet image forming apparatus (and a cleaning method for the apparatus) will be described with reference to the drawings.

First Embodiment

Figure 1:
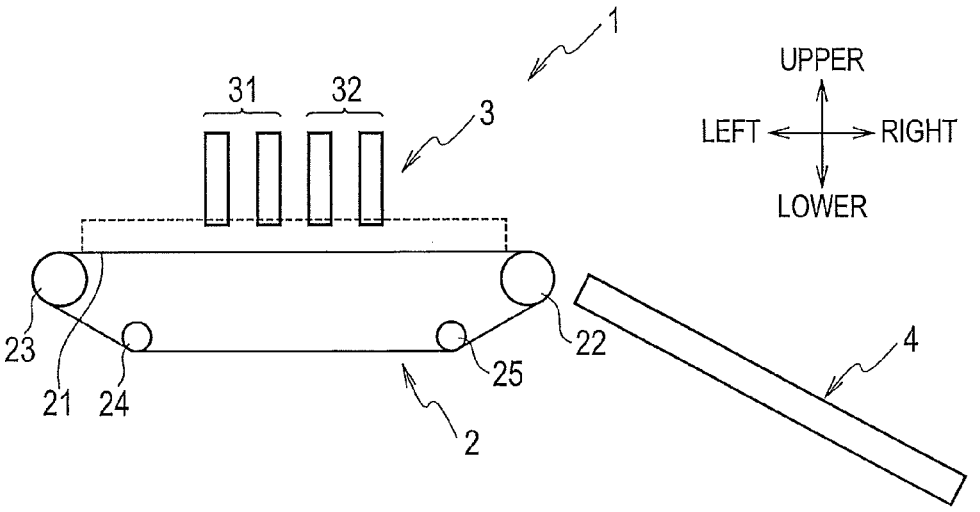
FIG. 1 is a schematically side view (normal state) of an inkjet image forming apparatus according to embodiments.
Figure 2:
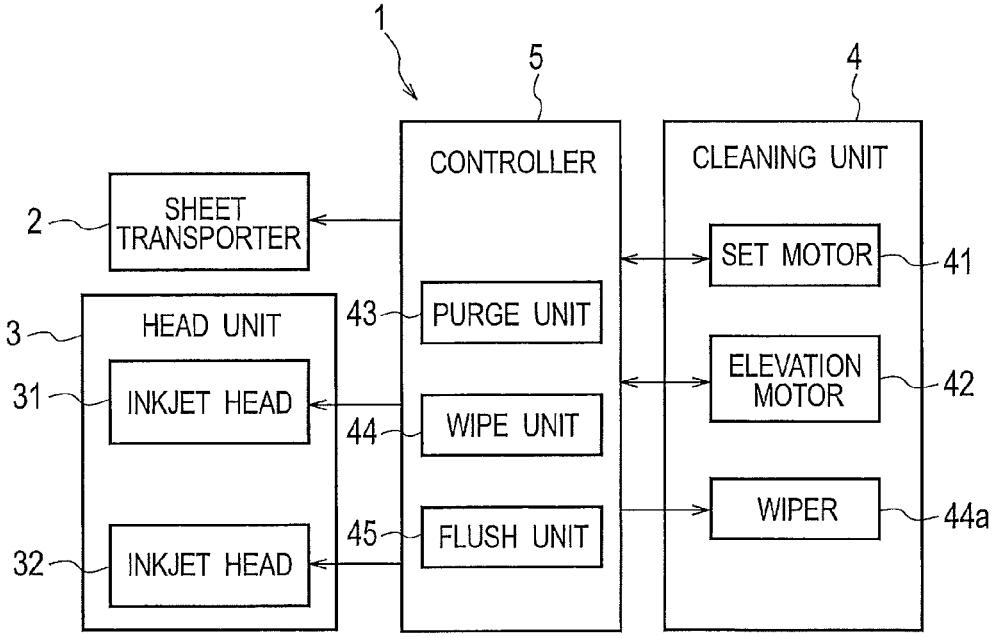
FIG. 2 is a block diagram of the inkjet image forming apparatus.

As shown in FIG. 1 and FIG. 2, an inkjet image forming apparatus 1 according to the present embodiment includes a sheet transfer unit 2, a head unit 3, a cleaning unit 4, and a controller 5.

The sheet transfer unit 2 includes a transfer belt 21 disposed so as to face to the head unit 3, a drive roller 22 that drives the transfer belt 21 circularly, and driven rollers 23 to 25 that are driven by the drive roller 22 via the transfer belt 21.

The transfer belt 21 is wound around the drive roller 22 and the driven rollers 23 to 25, and driven by the drive roller 22 endlessly during printing. The transfer belt 21 transfers a sheet (print paper) P fed from a sheet supply tray (not shown in the drawings) disposed on a left side in FIG. 1 to the head unit 3 (i.e. transfers the sheet P forward: rightward in FIG. 1).

Figure 6:
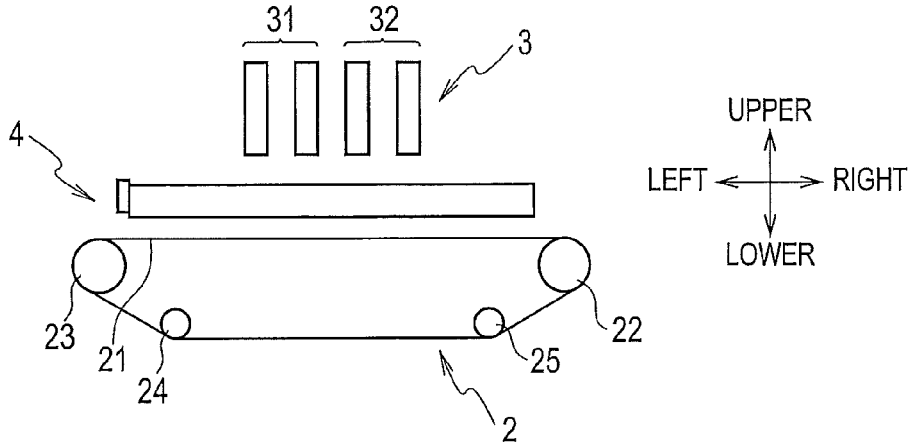
FIG. 6 is a schematically side view (cleaning operation 2) of the inkjet image forming apparatus.
Figure 7:
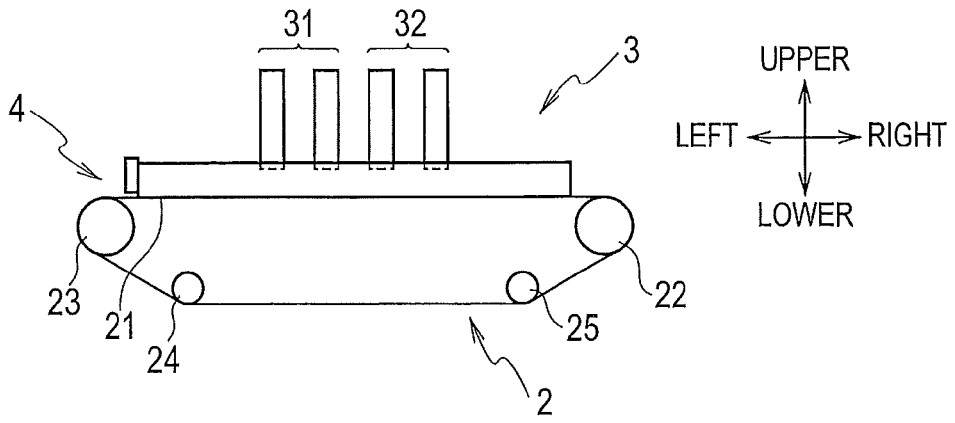
FIG. 7 is a schematically side view (cleaning operation 3) of the inkjet image forming apparatus.

The sheet transfer unit 2 can be moved vertically by an elevation motor 42 (see FIG. 2) to (1) a print position where the sheet transfer unit 2 executes a transfer process of the sheet P for printing, (2) a waiting position that is located beneath the printing position as shown in FIG. 6 and where the cleaning unit 4 is inserted between the sheet transfer unit 2 and the head unit 3, and (3) a cleaning position that is located above the wait position as shown in FIG. 7 and where the head unit 3 is cleaned by the cleaning unit 4 moved up together with the sheet transfer unit 2 moved up from the wait position. The downward movement of the sheet transfer unit 2 to the wait position is made for inserting the cleaning unit 4 between the sheet transfer unit 2 and the head unit 3. It depends on a height of the cleaning unit 4 which is located higher, the print position or the cleaning position.

Figure 3:
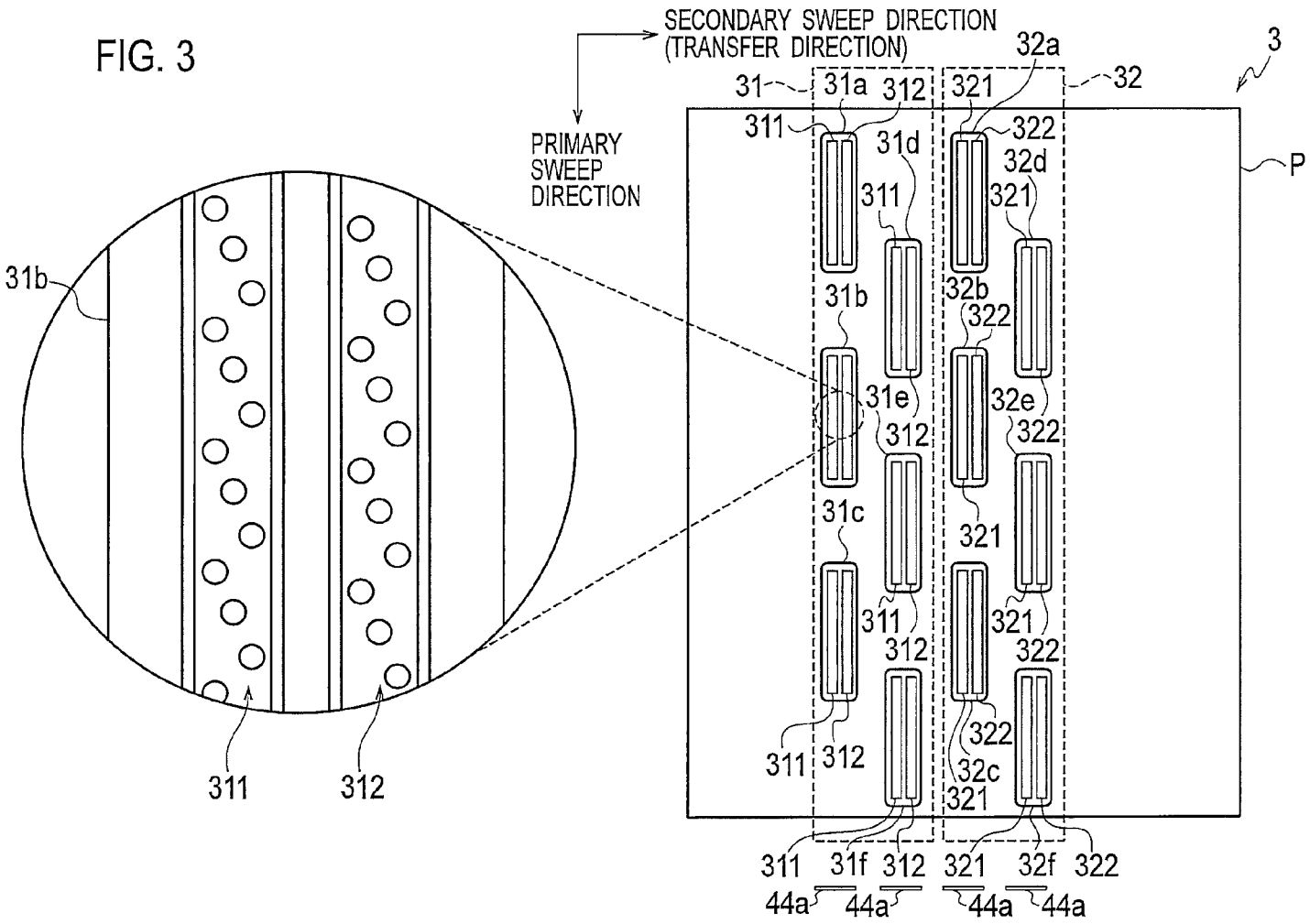
FIG. 3 is a bottom view of inkjet heads in an inkjet image forming apparatus according to a first embodiment.

The head unit 3 includes inkjet heads 31 and 32 each of which has two nozzle rows for two colors. Namely, each of the inkjet heads 31 and 32 is a 1-head-2-color line-type inkjet head. The head unit 3 (the inkjet heads 31 and 32) prints images on a sheet P by injecting ink droplets onto the sheet P transferred by the transfer belt 21. As shown in FIG. 3, the inkjet heads 31 (31*a* to 31*f*) and 32 (32*a* to 32*f*) are aligned along a primary sweep direction with predetermine intervals, and the primary sweep direction is perpendicular to a secondary sweep direction (=a transfer direction of the sheet P). In the head unit 3, the inkjet heads 31 (31*a* to 31*f*) and 32 (32*a* to 32*f*) are arranged in a staggered manner to form a 2×3 matrix arrangement.

In the inkjet head 31, the inkjet heads 31*a* to 31*c* are provided as its first column, and the inkjet heads 31*d* to 31*f* are provided as its second column Each of the inkjet heads 31*a* to 31*f* has two nozzle rows for two colors. Similarly in the inkjet head 32, the inkjet heads 32*a* to 32*c* are provided as its first column, and the inkjet heads 32*d* to 32*f* are provided as its second column Each of the inkjet heads 32*a* to 32*f* has two nozzle rows for two colors.

While a sheet P is transferred along the secondary sweep direction (=the transfer direction of the sheet P) beneath the head unit 3, different two color ink droplets are injected from each of the inkjet heads 31 and 32 to print images on the sheet P.

Namely, the head unit 3 includes the inkjet heads 31*a* to 31*f* that accumulate black (K) and cyan (C) inks, and the inkjet heads 32*a* to 32*f* that accumulate magenta (M) and yellow (Y) inks. Note that the inkjet heads 31*a* to 31*f* and the inkjet heads 32*a* to 32*f* inject different color inks from each other, but they have an identical physical structure to each other.

An ink chamber for accumulating black (K) ink or cyan (C) ink is formed in each inkjet heads 31*a* to 31*f*, and a piezoelectric element is disposed within the ink chamber. A drive voltage(s) for injecting ink is applied to the piezoelectric element based on a supplied signal, and thereby black (K) ink droplets are injected from upstream nozzle rows 311 and cyan (C) ink droplets are injected from downstream nozzle rows 312. For example, the black (K) and cyan (C) ink droplets are printed with a resolution of 300 dpi. Namely, nozzles in the nozzle rows 311 and 312 are aligned along the primary sweep direction so as to inject ink droplets with a resolution of 300 dpi.

On the other hand, in each of the inkjet heads 32*a* to 32*f*, an upstream nozzle row 321 for injecting magenta (M) ink droplets and a downstream nozzle rows 322 for injecting yellow (Y) ink droplets are aligned parallel to the primary sweep direction and parallel to each other so that the magenta (M) and yellow (Y) ink droplets are printed with a resolution of 300 dpi.

An ink chamber for accumulating magenta (M) ink or yellow (Y) ink is formed in each inkjet heads 32*a* to 32*f*, and a piezoelectric element is disposed within the ink chamber. A drive voltage(s) for injecting ink is applied to the piezoelectric element based on a supplied signal, and thereby magenta (M) ink droplets are injected from the upstream nozzle rows 321 and yellow (Y) ink droplets are injected from the downstream nozzle rows 322. The magenta (M) and yellow (Y) ink droplets are also printed with a resolution of 300 dpi.

The cleaning unit 4 cleans an ink injection surface of each of the inkjet heads 31 (31*a* to 31*f*) and the inkjet head 32 (32*a* to 32*f*). As shown in FIG. 2, the cleaning unit 4 includes a set motor 41, the elevation motor 42, a purge unit 43, a wipe unit 44, and a flush unit 45.

The cleaning unit 4 is located at its home position (accommodated position) that is shown by solid lines in FIG. 1 while printing is being done. The home position (accommodated position) is located on a lower-right side (in FIG. 1) of the sheet transfer unit 2. When cleaning is going to be done, the sheet transfer unit 2 is moved downward to the wait position (see FIG. 5) by the elevation motor 42, and then the cleaning unit 4 is moved (set) to a position set above the sheet transfer unit 2 (see FIG. 6) by the set motor 41. Subsequently, the cleaning unit 4 is moved upward to its cleaning position that is shown by dotted lined in FIG. 1 together with the sheet transfer unit 2 (see FIG. 7) by the elevation motor 42. The cleaning position is located between the sheet transfer unit 2 and the head unit 3.

The set motor 41 moves the cleaning unit 4 from the home position (accommodated position) to the cleaning position [and also moves back the cleaning unit 4 from the cleaning unit 4 to the home position (accommodated position)]. The elevation motor 42 elevates the cleaning unit 4 upward or downward together with the sheet transfer unit 2 [and also elevates only the sheet transfer unit 2 upward and downward].

The controller 5 controls operations of the inkjet image forming apparatus 1 to form images on a sheet (print sheet) P by controlling operations of the sheet transfer unit 2 and the head unit 3. In addition, the controller 5 includes a purge unit 43, a wipe unit 44 and a flush unit 45 on order to achieve its function, and carries out an after-described cleaning operation when a cleaning condition is satisfied by sending operation start signals to the purge unit 43, the wipe unit 44 and the flush unit 45.

The purge unit 43 carries out a purge process in the clearing operation. In the purge process, ink in the inkjet heads 31 and 32 is injected from the nozzle rows 311, 312, 321 and 322 of each of the inkjet heads 31 and 32 of the head unit 3. The ink injected from the nozzle rows 311, 312, 321 and 322 becomes droplets, and the droplets stay on a nozzle surface as purged ink droplets without dropping off from the nozzle surface.

The wipe unit 44 includes wipers 44*a* each of which is provided for each column of the inkjet heads 31 and 32 as shown in FIG. 3. Namely, the wipers 44*a* are provided for a row of the inkjet heads 31*a* to 31*c*, a row of the inkjet heads 31*d* to 31*f*, a row of inkjet heads 32*a* to 32*c*, and a row of the inkjet heads 32*d* to 32*f*. The wipers 44*a* are parallel to the secondary sweep direction (transfer direction). After the purge process by the purge unit 43, the wipe unit 44 carries out a wipe process. In the wipe process, the wipers 44*a* are moved in the primary sweep direction by a wiper motor (not shown in the drawings) to wipe out the purged ink droplets staying on the nozzle surface of the nozzle rows 311, 312, 321 and 322 of the inkjet heads 31 and 32.

After the wipe process by the wipe unit 44, the flush unit 45 carries out a flush process. In the flush process, ink is injected from the nozzle holes into which ink of different color from its color flows on the inkjet heads 31 and 32. For example, with respect to the inkjet heads 31, black (K) ink is prevented from flowing into the nozzles that inject cyan (C) ink by the flush process, and cyan (C) ink is prevented from flowing into the nozzles that inject black (K) ink by the flush process. Similarly, with respect to the inkjet heads 32, magenta (M) ink is prevented from flowing into the nozzles that inject yellow (Y) ink by the flush process, and yellow (Y) ink is prevented from flowing into the nozzles that inject magenta (M) ink by the flush process.

Figure 4:
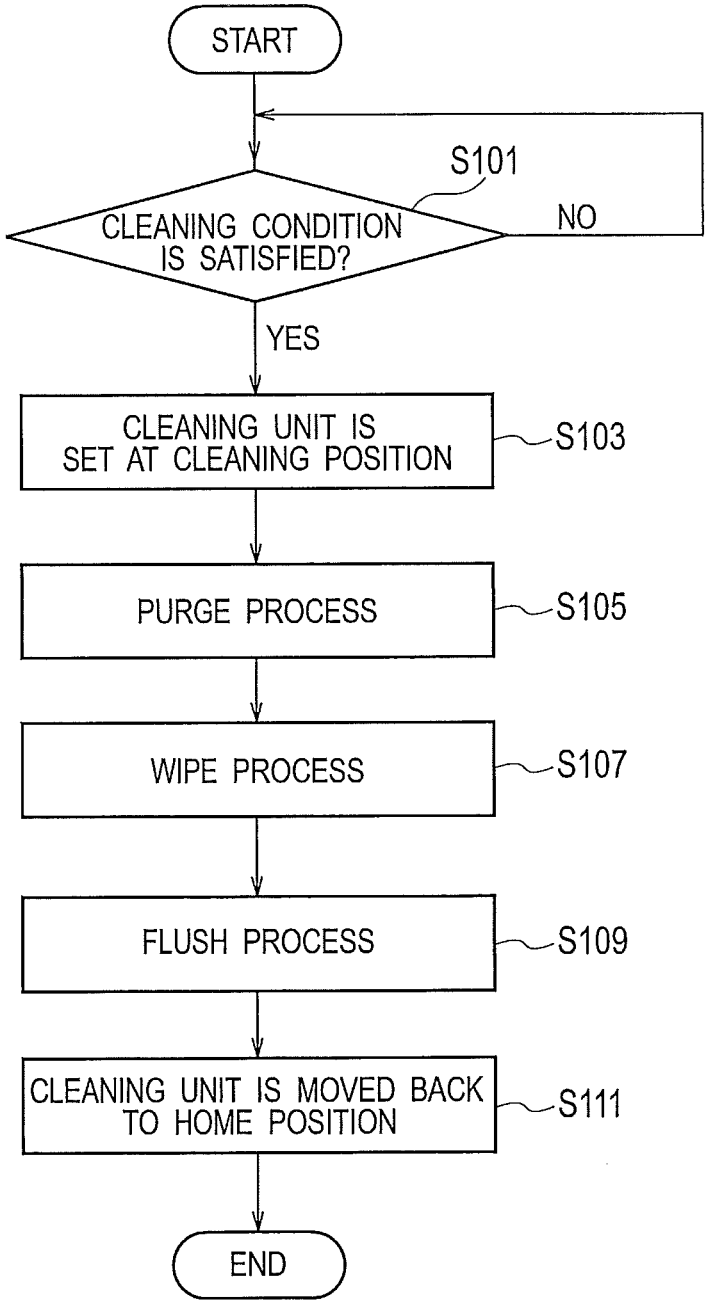
FIG. 4 is a flowchart of a cleaning operation of the inkjet image forming apparatus.

Next, the cleaning operation of the inkjet image forming apparatus 1 will be described with reference to a flowchart shown in FIG. 4.

Figure 5:
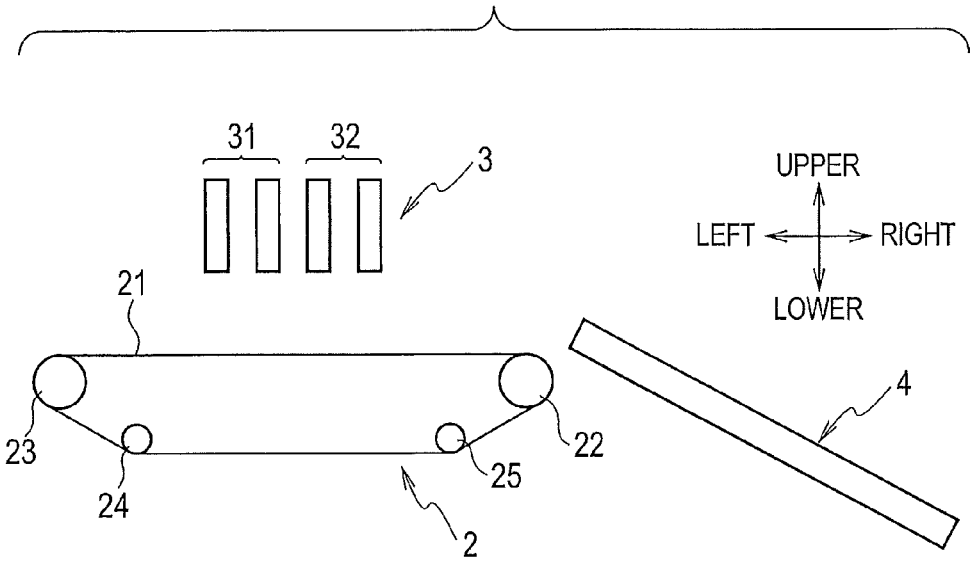
FIG. 5 is a schematically side view (cleaning operation 1) of the inkjet image forming apparatus.

When a cleaning condition is satisfied (YES in step S101), the controller 5 moves the cleaning unit 4 to the cleaning position (step S103). For example, the cleaning condition is satisfied, when the number of print operations has reached to the preset number of time. Alternatively, the cleaning condition is satisfied, when a user inputs a cleaning start command. The process of the step S103 will be explained more in detail. The controller 5 sends control commands to the elevation motor 42 to move the sheet transfer unit 2 downward to the wait position as shown in FIG. 5, and then sends control commands to the set motor 41 to move the cleaning unit 4 located at the home position (accommodated position) as shown in FIG. 5 to a position between the sheet transfer unit 2 located at the wait position and the head unit 3 as shown in FIG. 6. Subsequently, the controller 5 sends control commands to the elevation motor 42 to move the cleaning unit 4 and the sheet transfer unit 2 upward to the cleaning position as shown in FIG. 7.

After the step S103, the purge unit 43 carries out the purge process by injecting ink (black (K), cyan (C), magenta (M) and yellow (Y)) from nozzle rows 311, 312, 321 and 322 of the inkjet heads 31 and 32 of the head unit 3 (step S105). After the step S105, the wipe unit 44 carries out the wipe process by moving the wipers 44*a* in the primary sweep direction perpendicular to the transfer direction.

After the step S107, the flush unit 45 carries out the flush process by injecting ink (black (K), cyan (C), magenta (M) and yellow (Y)) from nozzle rows 311, 312, 321 and 322 of the inkjet heads 31 and 32 of the head unit 3 so that the ink is injected to generate mist (step S109). In the step S109, the flush unit 45 carries out the flush process only for a nozzle group(s) that includes nozzles into which ink of different color may be mixed with its ink in the nozzle rows 311, 312, 321 and 322 of the inkjet heads 31 and 32 of the head unit 3.

After the step S109, the controller 5 moves the sheet transfer unit 2 downward to the wait position together with the cleaning unit 4 by driving the elevation motor 42 as shown in FIG. 6, and then moves the cleaning unit 4 back to the home position (accommodated position) by driving the set motor 41 as shown in FIG. 5 (step S111). Subsequently, the sheet transfer unit 2 is moved upward by the elevation motor 42 to the print position as shown in FIG. 1.

Figure 8A:
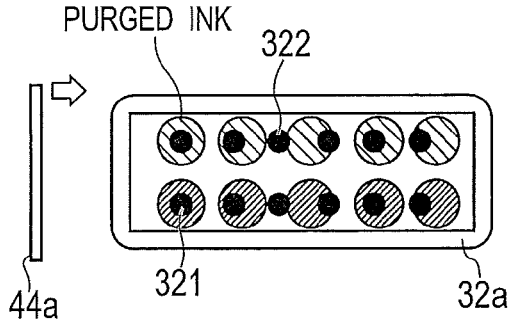
FIG. 8A and FIG. 8B are bottom views (adequate state) of an inkjet head during a wipe process.
Figure 8B:
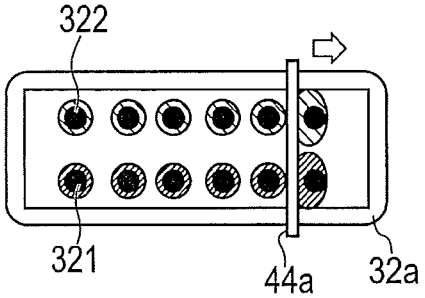

Next, cleaning states of the inkjet heads 31 (31*a* to 31*f*) and the inkjet heads 32 (32*a* to 32*f*) will be explained. Note that the cleaning state(s) will be explained by taking the inkjet head 32*a* as an example. FIG. 8A and FIG. 8B shows a current cleaning state (adequate state) of the 1-head-2-color inkjet head 32*a*.

In this case, magenta (M) ink is injected through nozzle holes in the nozzle row 321, and yellow (Y) ink is injected through nozzle holes in the nozzle row 322, in the purge process as shown in FIG. 8A. Note that nozzle holes in the nozzle rows 321 and 322 are shown larger than their actual size in FIG. 8A to FIG. 10B conveniently for explanations. Actually, the nozzle holes are much smaller than purged ink droplets as shown in FIG. 11, and a single purged ink droplet is formed by gathering of ink injected from plural nozzle holes.

In a case shown in FIG. 8A and FIG. 8B, purged ink droplets are not misaligned with respect to nozzle holes located most-upstream in a wipe direction, and ink is not remained on the wiper 44*a*. Therefore, in the case shown in FIG. 8A and FIG. 8B, only ink of identical color may flows into nozzle holes in a single nozzle row, and ink of different color doesn't flow into the nozzle holes as shown in FIG. 8B. In addition, if purged ink droplet(s) covers over the nozzle holes located most-upstream in the wipe direction, ink of different color doesn't flow into the nozzle holes even when the wiper 44*a* and/or on an upstream side of the inkjet head 32*a* is soiled by ink.

Figure 9A:
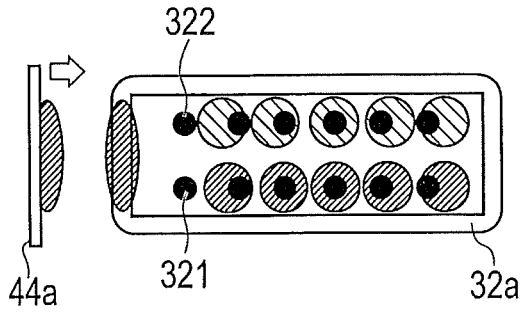
FIG. 9A and FIG. 9B are bottom views (mixture of ink occurs) of the inkjet head during a wipe process.
Figure 9B:
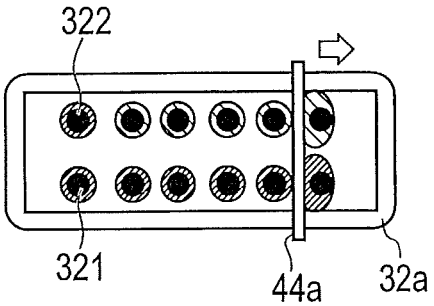

In a case shown in FIG. 9A and FIG. 9B, colors are mixed in the cleaning process of the 1-head-2-color inkjet head 32*a*. In this case, purged ink droplet(s) doesn't cover over nozzle holes located most-upstream in the wipe direction due to no injection of ink from the nozzle holes, and ink is remained on the wiper 44*a* and/or on the upstream side of the inkjet head 32*a*, as shown in FIG. 9A.

Therefore, since the nozzle holes located most-upstream are not covered by purged ink droplets injected in the purge process, the remained ink may flows into the nozzle holes located most-upstream that are not covered by purged ink droplets (i.e. no ink is supplied to the nozzle holes located most-upstream in the purge process) and thereby mixture of inks of different colors occurs as shown in FIG. 9B. In the inkjet image forming apparatus 1 according to the present embodiment, it is prevented by the flush process that the remained ink flows into the nozzle holes that are not covered by the purged ink droplets.

Figure 10A:
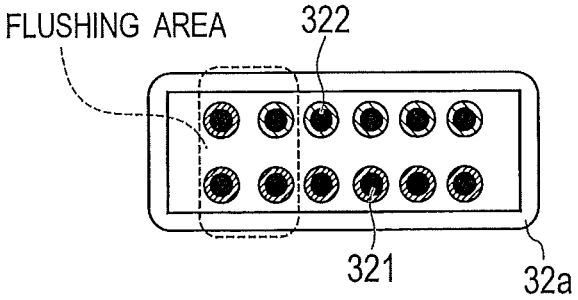
FIG. 10A and FIG. 10B are bottom views of the inkjet head during a flush process.
Figure 10B:
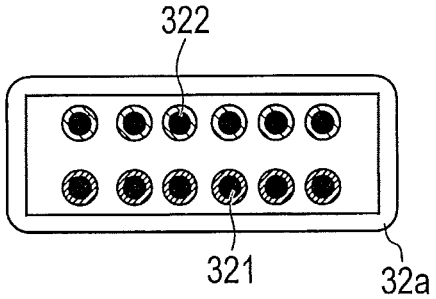
Figure 11:
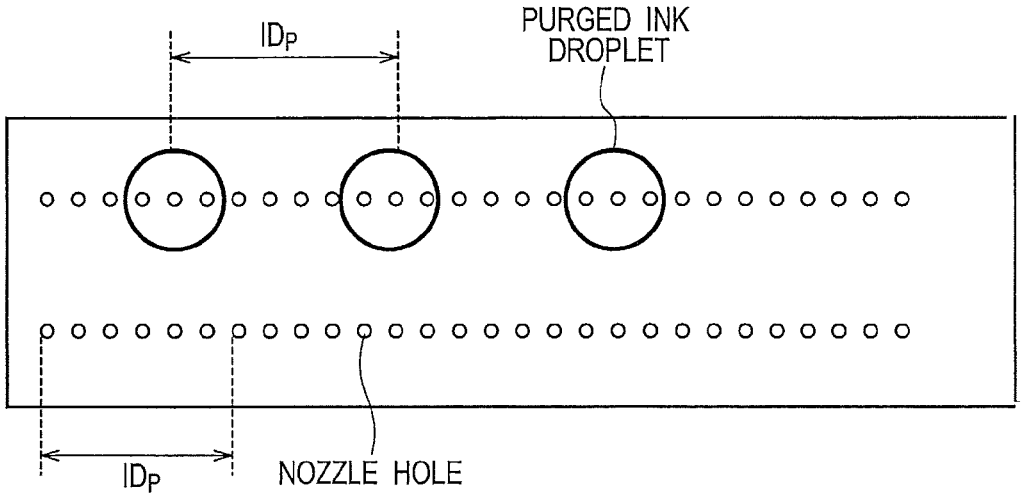
FIG. 11 as a bottom views (with purged ink droplets) of the inkjet head after a purge process.

A flush area in the inkjet image forming apparatus 1 according to the present embodiment is shown in FIG. 10A. In addition, FIG. 10A and FIG. 10B shows a state where mixture of ink is prevented in the 1-head-2-color inkjet head 32*a* by flushing. Namely, the flush unit 45 of the inkjet image forming apparatus 1 according to the present embodiment carries out flushing only for a nozzle group in a predetermined area located on an upstream side in the wipe direction where mixture of ink tends to occur, as shown in FIG. 10A.

For example, the flush unit 45 carries out flushing at least for a tend-to-occur area of mixture of ink, i.e. a predetermined area from a location of the most-upstream nozzle holes to a position of most-upstream purged ink droplets, in other words, an area from a location of the most-upstream nozzle holes to a position downstream by a pitch IDp from the location of the most-upstream nozzle holes as shown in FIG. 11. Note that the pitch IDp is a pitch between purged ink droplets (to be) formed by gathering of ink injected from plural nozzle holes. By setting the flush area as explained above, nozzle holes at which mixture of ink tends to occur can be surely included in the flush area.

Since there is a high possibility of mixture of ink at the nozzle group located upstream in the wipe direction as shown in FIG. 9A and FIG. 9B, at least the above-explained flush area is flushed by the flush unit 45 in the present embodiment, Note that the nozzle holes in the nozzle rows is aligned straight in FIG. 11, but they may be aligned obliquely per a predetermined number of them (per three nozzle holes) as in the nozzle rows 311 and 312 shown in FIG. 3.

According to the inkjet image forming apparatus 1 in the present embodiment, since the flush process is carried out only at the nozzle group in the predetermined area that is located on the most-upstream side in the wipe direction and in which mixture of ink tends to occur in the wipe process by the wiper(s) 44*a*, consumption of ink in the flush process can be prevented from increasing, and a replacement cycle of a mist-absorbing material for absorbing ink mists generated during the flush process can be prolonged.

Here, the flush may be carried out so that an amount of ink injected for flushing in the flush area in which mixture of ink tends to occur is gradually made smaller sequentially from the most-upstream nozzle hole(s). For example, in the flush process, an amount of ink injected from the most-upstream nozzle hole(s) is set to 15 droplets, an amount of ink injected from the second-upstream nozzle hole(s) is set to 10 droplets, and an amount of ink injected from the third-upstream nozzle hole(s) is 5 droplets. According to this, consumption of ink in the flush process can be reduced more, and a replacement cycle of a mist-absorbing material for absorbing ink mists generated during the flush process can be prolonged further.

Second Embodiment

In the present embodiment, the wipers 44*a* are inclined with respect to the secondary sweep direction (transfer direction) in order to reduce an amount of ink injected in the flush process (i.e. consumption of ink in the flush process) further.

Figure 12:
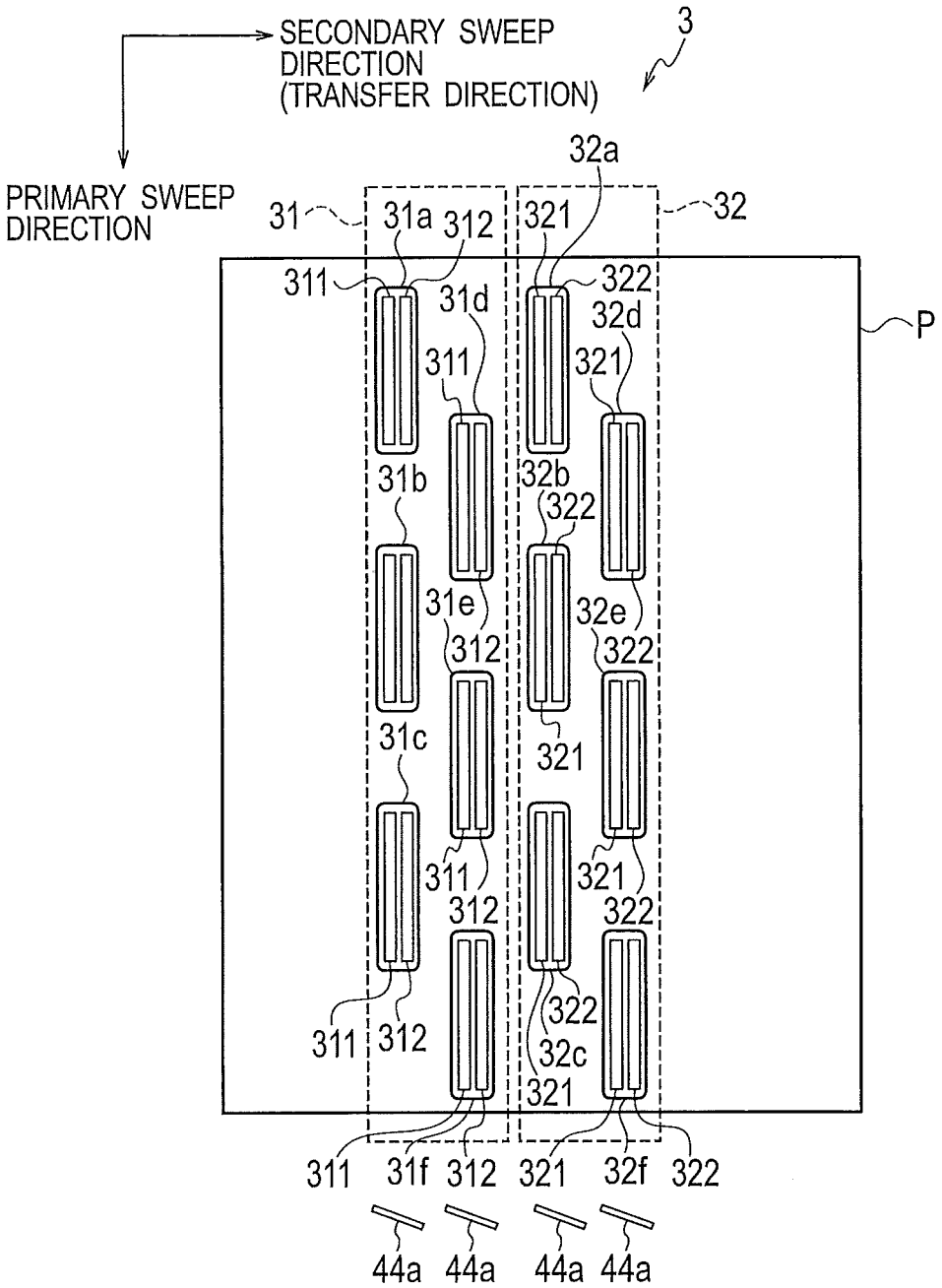
FIG. 12 is a bottom view of inkjet heads in an inkjet image forming apparatus according to a second embodiment.
Figure 13A:
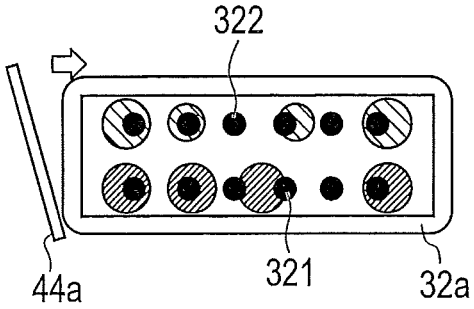
FIG. 13A and FIG. 13B are bottom views (mixture of ink occurs) of an inkjet head during a wipe process.
Figure 13B:
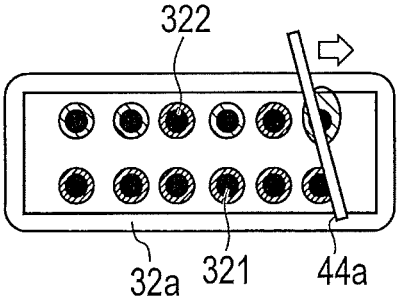

As shown in FIG. 12, all the wipers 44*a* are inclined so as to be parallel to each other. The wipers 44*a* are provided for a row of the inkjet heads 31*a* to 31*c*, a row of the inkjet heads 31*d* to 31*f*, a row of inkjet heads 32*a* to 32*c*, and a row of the inkjet heads 32*d* to 32*f*. Namely, the wipers 44*a* are inclined with respect to the rows. The wipe process is carried out as shown in FIGS. 13A and 13B (explained by taking the inkjet head 32*a* as an example).

By inclining the wipers 44*a*, purged ink droplets are wiped away to a constant side (rightward in FIG. 12) regardless of a state of the purged ink droplets. In the present embodiment shown in FIG. 12, ink droplets are wiped from a side of the nozzle row 311 of black (K) ink to a side of the nozzle row 312 of cyan (C) ink with respect to each of the inkjet heads 31*a* to 31*f*, and ink droplets are wiped away from a side of the nozzle row 321 of magenta (M) ink to a side of the nozzle row 322 of yellow (Y) ink with respect to each of the inkjet heads 32*a* to 32*f*.

In this case, when the wipe process is carried out by the inclined wiper 44*a* under a condition where nozzle holes in the predetermined area located on an upstream side in the wipe direction are not covered by purged ink droplets due to no purge of ink from the nozzle holes and ink is remained on the wiper 44*a* and/or on the upstream side of the inkjet head 32*a*, magenta (M) ink purged from the nozzle row 321 may flows into the nozzle row 322 of yellow (Y) ink by the swipe process and thereby mixture of ink may occur on the nozzle row 322.

As a result, the flush unit 45 carries out flushing only for one (322) of the nozzle rows 321 and 322 on which mixture of ink tends to occur due to the inclined wiper 44*a*. In the present embodiment, mixture of ink tends to occur on the nozzle row 322 of yellow (Y) ink more likely than on the nozzle row 321 of magenta (M) ink, so that flushing is carried out only for the nozzle row 322 and doesn't for the nozzle row 321.

According to the inkjet image forming apparatus 1 in the present embodiment, since flushing is carried out only for a nozzle row on which mixture of ink tends to occur due to the inclined wiper 44*a*, consumption of ink in the flush process can be reduced further, and a replacement cycle of the mist-absorbing material can be prolonged further.

Note that, even in the present embodiment, flushing may be carried out only in a predetermined area located on an upstream side in the wipe direction similarly in the above first embodiment. In this case, flushing is carried out only for a nozzle row on which mixture of ink tends to occur due to the inclined wiper 44*a* in the predetermined area located on an upstream side in the wipe direction. According to this, consumption of ink in the flush process can be reduced much further, and a replacement cycle of the mist-absorbing material can be prolonged much further.

Third Embodiment

Figure 14:
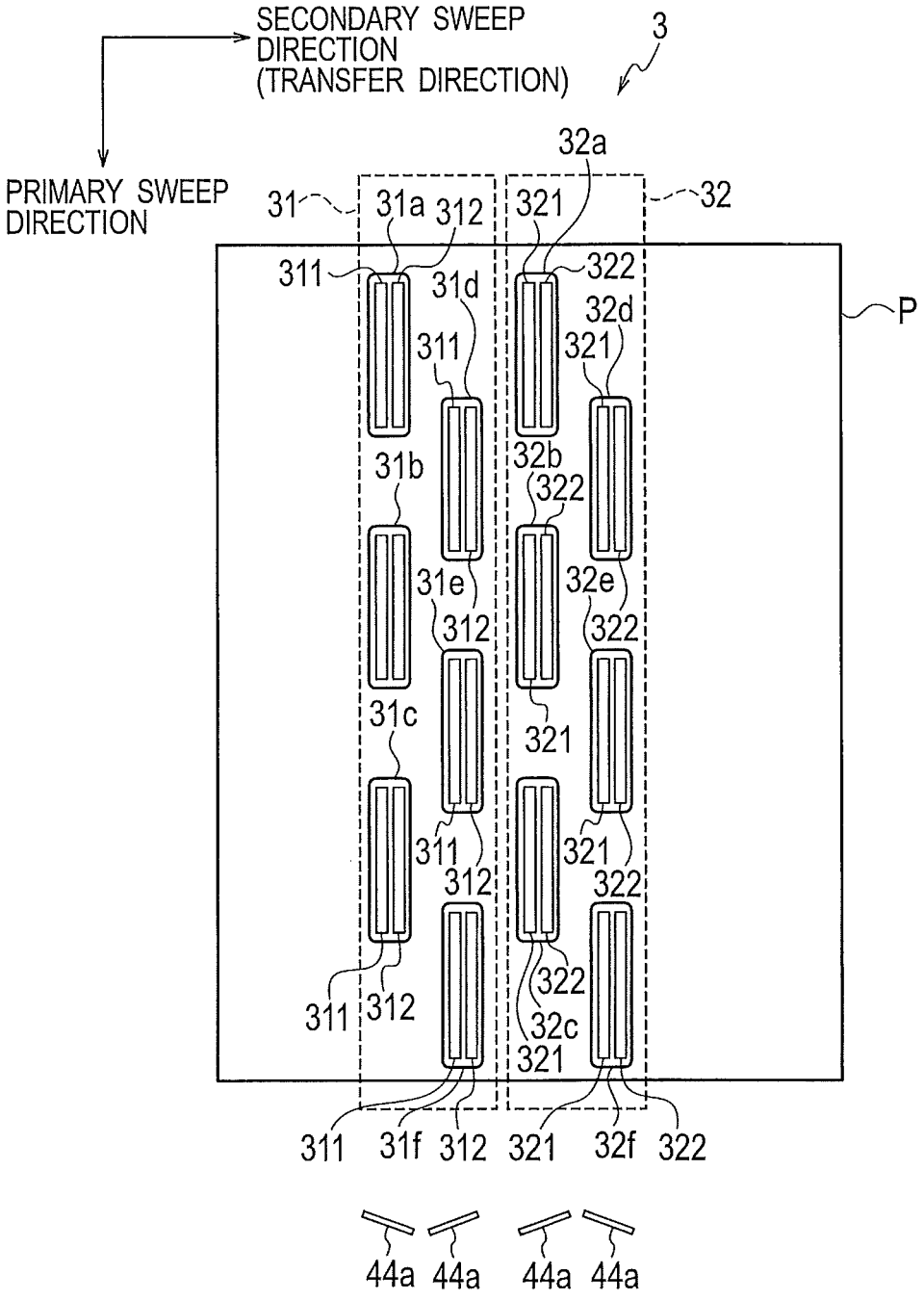
FIG. 14 is a bottom view of inkjet heads in an inkjet image forming apparatus according to a third embodiment.

In the present embodiment, the wipers 44*a* are inclined with respect to the secondary sweep direction (transfer direction) in order to reduce an amount of ink injected in the flush process (i.e. consumption of ink in the flush process) further, similarly to the above-described second embodiment. However, in the present embodiment, inclinations of the two wipers 44*a* in each of the inkjet heads 31 and 32 are different from each other as shown in FIG. 14. In a case where all the wipers 44*a* are inclined so as to be parallel to each other as in the above-described second embodiment, flushing is carried out only for one of the nozzle rows. Therefore, ink for the one of the nozzle rows is consumed more than ink for another of the nozzle rows. In the present embodiment, ink consumption is averaged with respect to all colors.

With respect to the inkjet head 31 that has two rows of inkjet heads 31*a* to 31*f*, the wiper 44*a* for the row of the inkjet heads 31*a* to 31*c* and the wiper 44*a* for the row of the inkjet heads 31*d* to 31*f* are inclined in different directions from each other. Similarly, with respect to the inkjet head 32 that also has two rows of inkjet heads 32*a* to 32*f*, the wiper 44*a* for the row of the inkjet heads 32*a* to 32*c* and the wiper 44*a* for the row of the inkjet heads 32*d* to 32*f* are inclined in different directions from each other.

In the present embodiment, the wiper 44*a* for the row of the inkjet heads 31*a* to 31*c* (on an upstream side along the transfer direction) and the wiper 44*a* for the row of the inkjet heads 31*d* to 31*f* (on a downstream side along the transfer direction) are inclined in opposite directions to each other.

Specifically, with respect to the inkjet heads 31*a* to 31*c* that inject black (K) ink and cyan (C) ink, the wiper 44*a* is inclined so that black (K) ink purged from the nozzle row 311 may flows into the nozzle row 312 of cyan (C) ink by the swipe process. On the other hand, with respect to the inkjet heads 31*d* to 31*f* that inject black (K) ink and cyan (C) ink, the wiper 44*a* is inclined so that cyan (C) ink purged from the nozzle row 312 may flows into the nozzle row 311 of black (K) ink by the swipe process. Therefore, with respect to the inkjet heads 31*a* to 31*c*, flushing is carried out only for the nozzle row(s) 312 of cyan (C) ink by the flush process. With respect to the inkjet heads 31*d* to 31*f*, flushing is carried out only for the nozzle row(s) 311 of black (K) ink by the flush process.

Similarly, with respect to the inkjet heads 32*a* to 32*c* that inject magenta (M) ink and yellow (Y) ink, the wiper 44*a* is inclined so that yellow (Y) ink purged from the nozzle row 322 may flows into the nozzle row 321 of magenta (M) ink by the swipe process. On the other hand, with respect to the inkjet heads 32*d* to 32*f* that inject magenta (M) ink and yellow (Y) ink, the wiper 44*a* is inclined so that magenta (M) ink purged from the nozzle row 321 may flows into the nozzle row 322 of yellow (Y) ink by the swipe process. Therefore, with respect to the inkjet heads 32*a* to 32*c*, flushing is carried out only for the nozzle row(s) 321 of magenta (M) ink by the flush process. With respect to the inkjet heads 32*d* to 32*f*, flushing is carried out only for the nozzle row(s) 322 of yellow (Y) ink by the flush process.

According to the inkjet image forming apparatus 1 in the present embodiment, since flushing is carried out only for a nozzle row on which, mixture of ink tends to occur due to the inclined wiper 44*a*, flushing is not needed for another nozzle row. Therefore, consumption of ink in the flush process can be reduced much further, and a replacement cycle of the mist-absorbing material can be prolonged much further. In addition, in a case where inkjet heads are aligned in two rows and each of the inkjet heads injects two different color ink (as the inkjet heads 31*a* to 31*f*, or the inkjet heads 32*a* to 32*f*), by inclining the wipers 44*a* for the two rows in opposite directions, consumption of the two color ink wasted in the flushing process for each of the inkjet heads can be averaged.

The present invention is not limited to the above-mentioned embodiment and modified examples, and it is possible to embody the present invention by modifying its components in a range that does not depart from the scope thereof. Further, it is possible to form various kinds of inventions by appropriately combining a plurality of components disclosed in the above-mentioned embodiment and modified examples. For example, it may be possible to omit several components from all of the components shown in the above-mentioned embodiment.

The present application claims the benefit of a priority under 35 U.S.C. §119 to Japanese Patent Application No. 2014-156006, filed on Jul. 31, 2014, the entire content of which is incorporated herein by reference.

What is claimed is:

1. An inkjet image forming apparatus comprising:

a plurality of inkjet heads each of which has two or more nozzle rows from which ink of different colors is injected, each of the nozzle rows including nozzle holes formed in a surface;

a wipe unit that includes wipers and carries out a wipe process to wipe away ink from the surface in which the nozzle rows are formed, the wipers are movable in a wiping direction that is perpendicular to a transfer direction of a print sheet past the plurality of inkjet heads; and a flush unit that carries out a variable flush process after the wipe process by injecting ink from at least some of the nozzle holes and ink is not injected from the remaining nozzle holes.

2. The inkjet image forming apparatus according to claim 1, wherein the flush unit carries out the flush process only for nozzle holes in a predetermined area located on an upstream side in the wiping direction of the wipers.

3. The inkjet image forming apparatus according to claim 1, wherein, the wipers are inclined with respect to the transfer direction of the print sheet, and the flush unit carries out the flush process by flushing only for one of the nozzle rows of each of the inkjet heads, ink being flown into the one of the nozzle rows by the wiper during the wipe process.

4. The inkjet image forming apparatus according to claim 3, wherein, the inkjet heads are aligned along the transfer direction so as to form two rows that are parallel to each other and are perpendicular to the transfer direction, and an inclination of the wiper for one of the two rows and an inclination of the wiper for another of the two rows are different from each other.

5. The inkjet image forming apparatus according to claim 1, wherein, the flush unit carries out the flush process so that an amount of ink injected for flushing in the flush process is gradually made smaller sequentially from a most-upstream nozzle hole in the wiping direction of the wipers.

6. A cleaning method for an inkjet image forming apparatus that includes a plurality of inkjet heads each of which has two or more nozzle rows from which ink of different colors is injected, each of the nozzle rows including nozzle holes formed in a surface, the method comprising:

carrying out a wipe process to wipe away ink from the surface in which the nozzle rows are formed, the wipe process is performed by moving wipers in a wiping direction that is perpendicular to a transfer direction of a print sheet past the plurality of inkjet heads; and carrying out a variable flush process after the wipe process by injecting ink from at least some of the nozzle holes and ink is not injected from the remaining nozzle holes.

* * * * *